US011434935B2

(12) United States Patent
Kondo et al.

(10) Patent No.: US 11,434,935 B2
(45) Date of Patent: Sep. 6, 2022

(54) HYDRAULIC PRESSURE SUPPLY DEVICE

(71) Applicant: KAWASAKI JUKOGYO KABUSHIKI KAISHA, Kobe (JP)

(72) Inventors: Akihiro Kondo, Kobe (JP); Hiroaki Mitsui, Kobe (JP); Toshihisa Toyota, Kobe (JP); Takashi Nakatsuji, Kakogawa (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 66 days.

(21) Appl. No.: 17/051,147

(22) PCT Filed: Apr. 22, 2019

(86) PCT No.: PCT/JP2019/017018
§ 371 (c)(1),
(2) Date: Oct. 27, 2020

(87) PCT Pub. No.: WO2019/208495
PCT Pub. Date: Oct. 31, 2019

(65) Prior Publication Data

US 2021/0048043 A1 Feb. 18, 2021

(30) Foreign Application Priority Data

Apr. 27, 2018 (JP) ..... JP2018-086806

(51) Int. Cl.
*F15B 11/08* (2006.01)
*F15B 21/08* (2006.01)
*F04B 49/06* (2006.01)

(52) U.S. Cl.
CPC ..... *F15B 11/08* (2013.01); *F15B 21/082* (2013.01); *F04B 49/065* (2013.01);
(Continued)

(58) Field of Classification Search
CPC ..... F15B 11/08; F15B 2211/27; F15B 2211/20515; F15B 2211/20553;
(Continued)

(56) References Cited

U.S. PATENT DOCUMENTS 4,801,247 A * 1/1989 Hashimoto ..... F04B 49/06 417/213
5,050,379 A * 9/1991 Nagai ..... F04B 49/20 60/434
5,285,642 A 2/1994 Watanabe et al.
5,486,106 A * 1/1996 Hehl ..... G05D 3/20 264/40.5
(Continued)

FOREIGN PATENT DOCUMENTS

JP H05-215101 A 8/1993
JP 2003-172302 A 6/2003
(Continued)

*Primary Examiner* — Abiy Teka
*Assistant Examiner* — Michael Quandt
(74) *Attorney, Agent, or Firm* — Oliff PLC

(57) ABSTRACT

A hydraulic pressure supply device includes: a hydraulic pump capable of changing a discharge capacity; an electric motor capable of changing a rotational frequency; a discharge capacity adjustment mechanism capable of adjusting the discharge capacity of the pump between a maximum and minimum discharge capacity; a pressure detector configured to detect pressure of an operating liquid discharged from the pump; a rotational frequency detector configured to detect the rotational frequency of the motor; and a controller configured to control operations of the motor and adjustment mechanism based on the rotational frequency, detected by the detector, to keep pressure of an actuator at arbitrary pressure, wherein, the controller controls the operation of the adjustment mechanism so the discharge capacity of the pump becomes a set lower limit discharge capacity. The set lower limit discharge capacity is set to be larger than the minimum discharge capacity and be adjustable by the controller.

6 Claims, 4 Drawing Sheets

(52) U.S. Cl.
CPC ..... *F15B 2211/20515* (2013.01); *F15B 2211/20553* (2013.01); *F15B 2211/20561* (2013.01); *F15B 2211/27* (2013.01); *F15B 2211/633* (2013.01); *F15B 2211/6309* (2013.01); *F15B 2211/6343* (2013.01); *F15B 2211/6652* (2013.01); *F15B 2211/7053* (2013.01)

(58) Field of Classification Search
CPC .... F15B 2211/20561; F15B 2211/6652; F15B 2211/7053; F15B 21/082; F04B 49/06; F04B 49/065; F04B 49/008; F04B 49/20
See application file for complete search history.

(56) References Cited

U.S. PATENT DOCUMENTS

| | | | | |
|---|---|---|---|---|
| 7,846,358 | B2 * | 12/2010 | Shimizu | B29C 45/82 425/149 |
| 7,938,994 | B2 * | 5/2011 | Tanemura | B29C 45/82 425/451.2 |
| 2007/0052138 | A1 | 3/2007 | Yamaura et al. | |
| 2012/0189463 | A1 | 7/2012 | Toyota et al. | |
| 2012/0240566 | A1 | 9/2012 | Ohtsuka et al. | |

FOREIGN PATENT DOCUMENTS

| | | | |
|---|---|---|---|
| JP | 4324148 | B2 | 9/2009 |
| JP | 2011-85044 | A | 4/2011 |
| JP | 2011-102608 | A | 5/2011 |
| JP | 2015-001291 | A | 1/2015 |
| WO | 92/006306 | A1 | 4/1992 |

* cited by examiner

HYDRAULIC PRESSURE SUPPLY DEVICE

TECHNICAL FIELD

The present invention relates to a hydraulic pressure supply device configured to supply hydraulic pressure to an actuator to drive the actuator.

BACKGROUND ART

Known is a hydraulic pressure supply device configured to supply hydraulic pressure from a hydraulic pump to an actuator to drive the actuator. In the hydraulic pressure supply device, the hydraulic pump is driven and rotated by an electric motor, such as a servomotor, capable of controlling a rotational frequency. A discharge flow rate of the hydraulic pump can be adjusted by controlling the rotational frequency of the electric motor, and this can control the speed, position, and load of the actuator. Moreover, in the hydraulic pressure supply device, a discharge capacity of the hydraulic pump is variable. Examples of such hydraulic pressure supply device include drive systems disclosed in PTLs 1 and 2.

In the drive system of PTL 1, control is changed depending on the magnitude of discharge pressure. When the discharge pressure is less than predetermined cutoff start pressure, the discharge flow rate of the pump is controlled by adjusting the rotational frequency of the electric motor. When the discharge pressure reaches the predetermined cutoff start pressure, the rotational frequency of the electric motor is kept constant, and the discharge flow rate of the pump is controlled by adjusting the discharge capacity of the pump.

In the drive system of PTL 2, the capacity of the pump can be switched to one of two types of capacities. In a pressure keeping step which does not require a high flow rate, the capacity of the pump is set to a smaller capacity. Moreover, a controller controls the rotational frequency of the servomotor in order that the torque of the pump is secured to be a constant value.

CITATION LIST

Patent Literature

PTL 1: Japanese Laid-Open Patent Application Publication No. 2003-172302

PTL 2: Japanese Patent No. 4324148

SUMMARY OF INVENTION

Technical Problem

According to the drive systems of PTLs 1 and 2, when an object of the drive system is to keep the pressure of an operating liquid supplied to the actuator, it is unnecessary to supply a large amount of operating liquid. Therefore, in the drive system of PTL 1, the pump includes a pressure adjustment (cutoff) mechanism, and the capacity of the pump is mechanically adjusted by the pressure adjustment mechanism. For example, in the pressure keeping step, the capacity of the pump is adjusted by the pressure adjustment mechanism to such a capacity that cutoff pressure can be kept. However, since the cutoff pressure is fixed at initially adjusted pressure, the pressure cannot be adjusted in accordance with loads of a machine (i.e., differences of thicknesses and materials of products in a press, differences of materials in resin/powder molding, etc.).

In the drive system of PTL 2, the discharge capacity of the pump is set to a minimum discharge capacity. The minimum discharge capacity is realized in such a manner that typically, tilting of a swash plate is mechanically limited so as not to become an angle smaller than a predetermined angle. The tilting of the swash plate is limited mostly by a mechanical stopper or the like. Therefore, in order to change the minimum discharge capacity, it is necessary to change the design of the pump. To be specific, when pumps are the same in size as each other but are different in minimum discharge capacity from each other, different parts are required to be used in the pumps. Therefore, the parts cannot be mass-produced, and this increases the manufacturing cost for the pump. Therefore, the minimum discharge capacities of the pumps which are the same in size as each other are set to be equal to each other regardless of use modes of the pumps. Or, there are pumps each of whose minimum discharge capacity can be adjusted by a screw or the like. However, in this case, since it is necessary to readjust the adjustment screw every time the type of a workpiece is changed, i.e., every time so-called set-up change is performed, the working property deteriorates.

Next, the following will focus on an internal leakage rate (leakage rate inside a pump) when pressure is kept in each of the two drive systems. The internal leakage rate of each drive system changes depending on devices constituting the drive system and driving states of the drive system, such as the temperature and pressure of the operating liquid. As described above, the minimum discharge capacity of the pump is set to a certain value regardless of the use modes and the driving states. Therefore, in order that the shortage of the flow rate of the operating liquid due to internal leakage can be compensated regardless of the use modes and the driving states, the minimum discharge capacity is set to be larger than a capacity corresponding to a highest one of the flow rates of the assumed internal leakage. In this case, in a pressure keeping state, pump driving torque determined by a product of the pump discharge pressure and the pump discharge capacity increases. Therefore, a large-scale (high-power) electric motor is required.

In order to suppress an increase in size of the electric motor, the minimum discharge capacity may be set to a capacity smaller than the above-described capacity. In this case, since the discharge flow rate of the pump is determined by the product of the pump discharge capacity and the pump rotational frequency, the flow rate of the operating liquid corresponding to the internal leakage rate can be compensated by making the rotational frequency of the electric motor higher than the above-described case. However, when the operating liquid becomes high in temperature due to continuous operation or the like or when an ambient temperature is high in summer or the like, the following will occur. To be specific, when the operating liquid becomes high in temperature, the internal leakage rate in the drive system increases, and therefore, a larger amount of operating liquid needs to be discharged from the pump. In this case, the electric motor needs to be driven at a rotational frequency higher than the assumed rotational frequency. Therefore, driving sound generated from the electric motor at this time becomes large, and the frequency of the driving sound generated changes in accordance with an increase in the rotational frequency. Thus, the driving sound becomes harsh, i.e., becomes noise. To be specific, the rotational frequency of the electric motor changes depending on the use mode of the pump, and this generates the noise.

An object of the present invention is to provide a hydraulic pressure supply device capable of suppressing a change in the rotational frequency of an electric motor in a pressure keeping state of keeping the pressure of an actuator.

Solution to Problem

A hydraulic pressure supply device of the present invention is a hydraulic pressure supply device configured to supply to an actuator an operating liquid having keeping pressure corresponding to a load applied to the actuator. The hydraulic pressure supply device includes: a hydraulic pump configured to change a discharge capacity of the hydraulic pump and discharge the operating liquid at a flow rate corresponding to the discharge capacity and a rotational frequency at which the hydraulic pump is driven; an electric motor configured to drive and rotate the hydraulic pump and change a rotational frequency of the electric motor; a discharge capacity adjustment mechanism configured to adjust the discharge capacity of the hydraulic pump within a range between a predetermined maximum discharge capacity and a predetermined minimum discharge capacity; a pressure detector configured to detect pressure of the operating liquid discharged from the hydraulic pump; a rotational frequency detector configured to detect the rotational frequency of the electric motor; and a controller configured to control operations of the electric motor and the discharge capacity adjustment mechanism based on the rotational frequency detected by the rotational frequency detector such that the pressure detected by the pressure detector is kept at the keeping pressure. When keeping the pressure of the operating liquid, to be supplied to the actuator, at the keeping pressure, the controller controls the operation of the discharge capacity adjustment mechanism such that the discharge capacity of the hydraulic pump becomes a set lower limit discharge capacity. The set lower limit discharge capacity is set to be larger than the minimum discharge capacity and be changed by the controller.

According to the present invention, the discharge capacity of the hydraulic pump in a pressure keeping state in which the pressure of the actuator is kept is set to the set lower limit discharge capacity that is larger than the minimum discharge capacity, and the set lower limit discharge capacity can be adjusted. To be specific, even when a mechanical device used changes, the set lower limit discharge capacity can be adjusted in accordance with a driving state of the hydraulic pressure supply device in the pressure keeping state, such as the rotational frequency of the electric motor and the temperature of the operating liquid. Therefore, the increase in the rotational frequency of the electric motor in order to keep the hydraulic pressure of the operating liquid in the pressure keeping state can be suppressed.

In the above invention, the controller may adjust the set lower limit discharge capacity in accordance with the rotational frequency detected by the rotational frequency detector.

According to the above configuration, the rotational frequency of the electric motor can be kept at or around a desired rotational frequency.

In the above invention, when keeping the pressure of the actuator, the controller may execute a first operation mode of controlling the operation of the discharge capacity adjustment mechanism such that: when the rotational frequency of the electric motor detected by the rotational frequency detector is a predetermined first prescribed rotational frequency or less, the set lower limit discharge capacity is set to a first predetermined capacity; and when the rotational frequency of the electric motor detected by the rotational frequency detector exceeds the first prescribed rotational frequency, the set lower limit discharge capacity is made larger than the first predetermined capacity in order that the rotational frequency of the electric motor becomes the first prescribed rotational frequency or less.

According to the above configuration, the rotational frequency of the electric motor can be suppressed to the first prescribed rotational frequency or less. The following can be realized by suppressing the rotational frequency of the electric motor to the first prescribed rotational frequency or less. To be specific, the driving sound generated from the electric motor can be suppressed to not more than the driving sound generated from the electric motor which is rotated at the first prescribed rotational frequency. In addition, it is possible to prevent a case where a driving sound frequency is high, and the driving sound is harsh. Therefore, the first prescribed rotational frequency is set to such a rotational frequency that the generated driving sound is an allowable volume of sound or less, or the driving sound frequency is an assumed frequency or less. With this, the noise generated by the hydraulic pressure supply device can be reduced.

In the above invention, the hydraulic pressure supply device may further include a switching portion configured to switch operation modes when keeping the pressure of the actuator. The controller may switch the operation mode to the first operation mode or a second operation mode in accordance with an operation with respect to the switching portion. In the second operation mode, the set lower limit discharge capacity may be set to a second predetermined capacity in order that the pressure detected by the pressure detector is kept at the keeping pressure, the second predetermined capacity being smaller than the first predetermined capacity.

According to the above configuration, in the second operation mode, in order to keep the pressure of the actuator, the electric motor can be rotated at the driving torque lower than that in the first operation mode. As above, since the electric motor can be rotated at the driving torque lower than that in the first operation mode, the electric motor can be rotated by current smaller than that in the first operation mode. Moreover, since the two operation modes can be switched by the operation with respect to the switching portion, mode switching is easy.

In the above invention, the controller may switch the operation mode to a third operation mode in accordance with the operation with respect to the switching portion. In the third operation mode, the set lower limit discharge capacity may be set to a third predetermined capacity in order that the pressure detected by the pressure detector is kept at the keeping pressure, the third predetermined capacity being larger than the second predetermined capacity and smaller than the first predetermined capacity.

According to the above configuration, in the third operation mode, in order to keep the pressure of the actuator, the electric motor can be rotated at the rotational frequency that is higher than that in the first operation mode and lower than that in the second operation mode. Therefore, the electric motor can be driven by current smaller than that in the first operation mode while making the driving sound smaller than that in the second operation mode. To be specific, the electric motor can be driven by current smaller than that in the first operation mode while making the noise smaller than that in the second operation mode.

In the above invention, the hydraulic pressure supply device may further include a liquid temperature detector configured to detect a temperature of the operating liquid.

The controller may adjust a value of the set lower limit discharge capacity in accordance with a liquid temperature detected by the liquid temperature detector.

According to the above configuration, even when the liquid temperature increases, the pressure of the operating liquid can be kept at the keeping pressure. Therefore, the increase in the rotational frequency of the electric motor in order to keep the pressure can be suppressed, and therefore, the increase in the driving sound of the electric motor can be suppressed.

Advantageous Effects of Invention

According to the present invention, the change in the rotational frequency of the electric motor can be suppressed in the pressure keeping state in which the pressure of the actuator is kept.

DESCRIPTION OF EMBODIMENTS

Hereinafter, a hydraulic pressure supply device 1 according to an embodiment of the present invention will be described with reference to the drawings. It should be noted that directions stated in the following description are used for convenience sake, and directions and the like of components of the present invention are not limited. Moreover, the hydraulic pressure supply device 1 described below is just one of embodiments of the present invention. Therefore, the present invention is not limited to the embodiment, and additions, deletions, and modifications may be made within the scope of the present invention.

Figure 1:
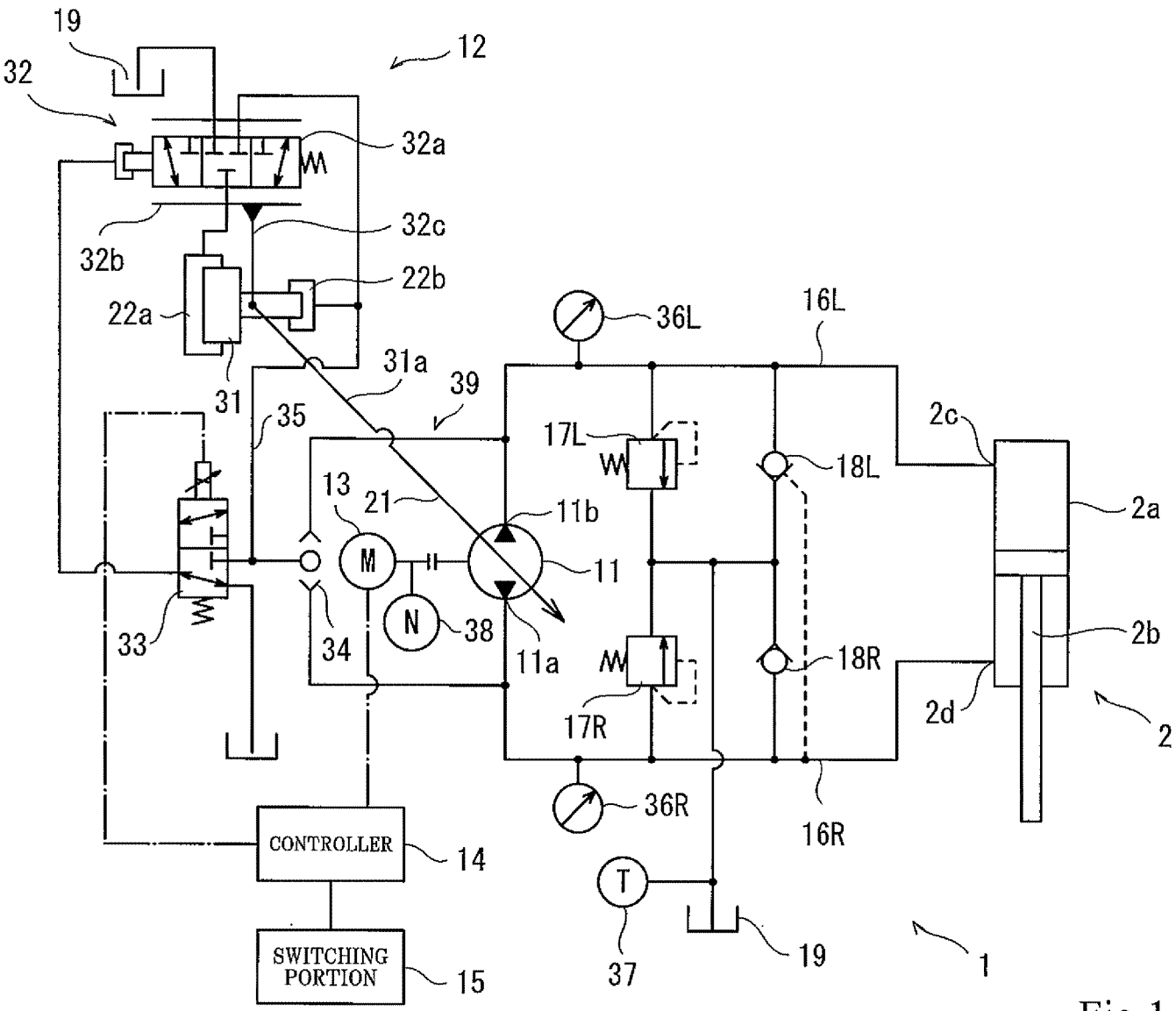
FIG. 1 is a hydraulic circuit diagram showing the configuration of a hydraulic pressure supply device of the present embodiment.

Industrial machines and robots include various actuators, such as cylinder mechanisms and hydraulic motors, and can perform various types of work by moving the actuators. For example, as shown in FIG. 1, the industrial machine, the robot, or the like includes a double acting type cylinder mechanism 2 that is one example of the actuator. The hydraulic pressure supply device 1 is connected to the cylinder mechanism 2. The hydraulic pressure supply device 1 supplies an operating liquid (oil, water, or the like) to the cylinder mechanism 2 to activate the cylinder mechanism 2. Hereinafter, the hydraulic pressure supply device 1 will be described in more detail.

Hydraulic Pressure Supply Device 1

As described above, the hydraulic pressure supply device 1 supplies the operating liquid to the cylinder mechanism 2 to activate the cylinder mechanism 2. In addition, the hydraulic pressure supply device 1 controls the operation of the cylinder mechanism 2 by adjusting a flow direction, flow rate, and the like of the supplied operating liquid. The hydraulic pressure supply device 1 having such functions mainly includes a hydraulic pump 11, a discharge capacity adjustment mechanism 12, an electric motor 13, a controller 14, and a switching portion 15. The hydraulic pump 11 is a bidirectional rotation pump and discharges the operating liquid in a direction corresponding to a rotational direction thereof. More specifically, the hydraulic pump 11 includes two ports 11*a* and 11*b*. When the hydraulic pump 11 rotates in a forward direction, the hydraulic pump 11 sucks the operating liquid through the port 11*a* and discharges the operating liquid through the port 11*b*. Moreover, when the hydraulic pump 11 rotates in a reverse direction, the hydraulic pump 11 sucks the operating liquid through the port 11*b* and discharges the operating liquid through the port 11*a*. The cylinder mechanism 2 is connected to the ports 11*a* and 11*b*, through which the operating liquid is sucked or discharged as above, via a first liquid passage 16R and a second liquid passage 16L, and the hydraulic pump 11 constitutes a closed circuit together with the cylinder mechanism 2.

The cylinder mechanism 2 is of a double-acting type and includes a cylinder 2*a* and a rod 2*b*. The rod 2*b* is inserted into the cylinder 2*a* so as to be able to reciprocate. The cylinder 2*a* includes a head-side port 2*c* and a rod-side port 2*d*. The head-side port 2*c* and the rod-side port 2*d* are connected to a head-side space and a rod-side space, respectively. The second liquid passage 16L is connected to the head-side port 2*c*, and the first liquid passage 16R is connected to the rod-side port 2*d*. According to the hydraulic cylinder mechanism 2 configured as above, when the operating liquid is supplied from the hydraulic pump 11 through the first liquid passage 16R to the rod-side port 2*d*, the rod 2*b* retreats relative to the cylinder 2*a*. When the operating liquid is supplied from the hydraulic pump 11 through the second liquid passage 16L to the head-side port 2*c*, the rod 2*b* advances relative to the cylinder 2*a*. As above, the cylinder mechanism 2 operates by the operating liquid supplied from the hydraulic pump 11 and operates (i.e., advances or retreats) in an operating direction corresponding to the flow direction of the operating liquid.

Figure 2:
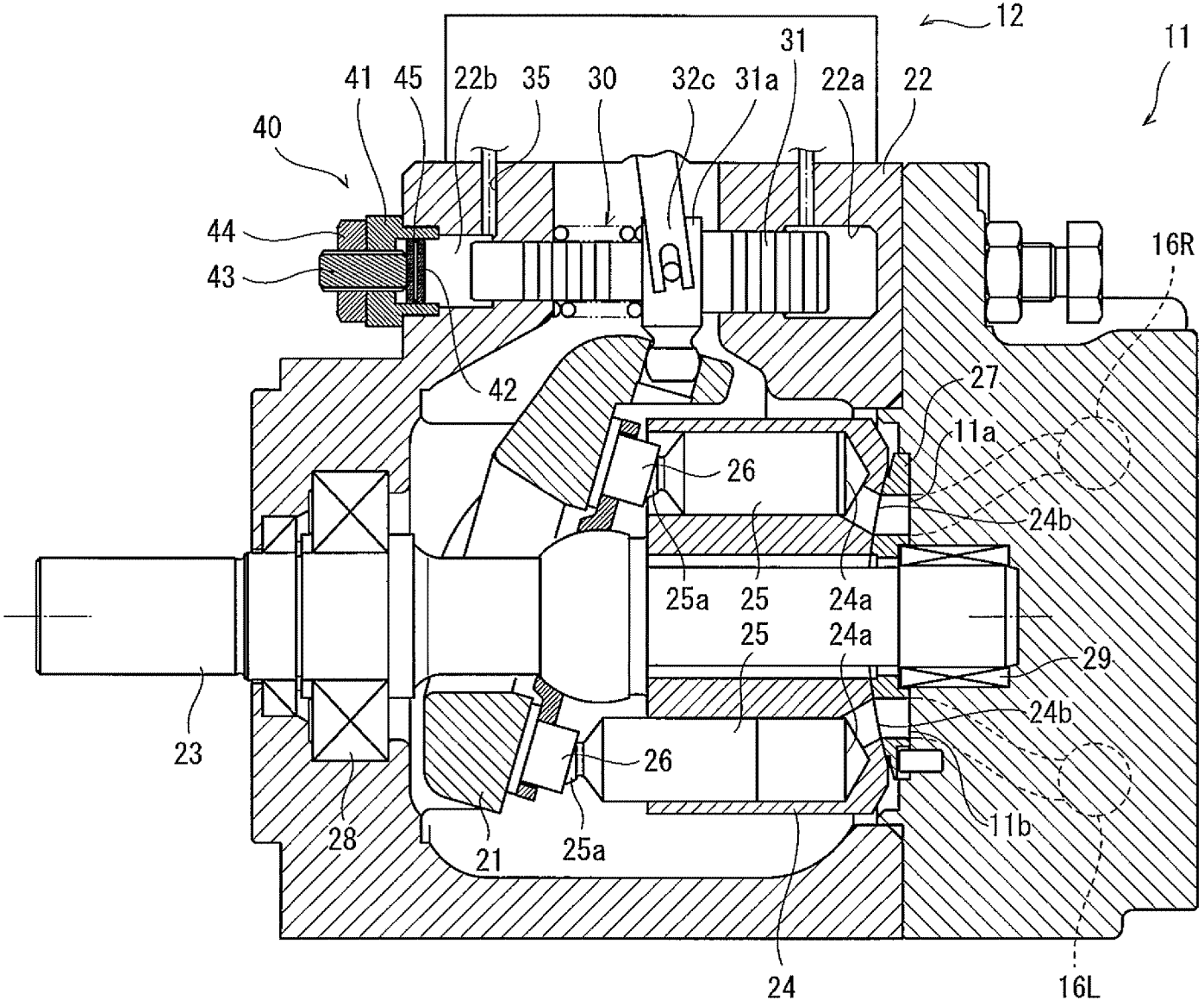
FIG. 2 is a sectional view of a hydraulic pump included in the hydraulic pressure supply device of FIG. 1.

The hydraulic pump 11 having such functions is a so-called variable displacement swash plate pump and includes a swash plate 21. The swash plate 21 is configured to be tiltable, and the hydraulic pump 11 changes a discharge capacity q in accordance with a tilting angle of the swash plate 21. Hereinafter, one example of the configuration of the hydraulic pump 11 will be described in more detail with reference to FIG. 2. In addition to the swash plate 21, the hydraulic pump 11 includes a casing 22, a rotating shaft 23, a cylinder block 24, a plurality of pistons 25, a plurality of shoes 26, and a valve plate 27. The casing 22 is formed to be hollow and accommodates the rotating shaft 23, the cylinder block 24, the plurality of pistons 25, the plurality of shoes 26, and the valve plate 27.

The rotating shaft 23 that is one of the members accommodated is formed in a substantially columnar shape. An axially intermediate portion and one end portion of the rotating shaft 23 are supported by the casing 22 through bearing members 28 and 29 such that the rotating shaft 23 is rotatable in a forward direction and a reverse direction. The other end portion of the rotating shaft 23 projects from the casing 22, and the electric motor 13 is coupled to the other end portion of the rotating shaft 23. A base end-side portion of the rotating shaft 23 is inserted through the cylinder block 24. The cylinder block 24 is coupled to the rotating shaft 23 such that: an axis of the cylinder block 24 and an axis of the rotating shaft 23 coincide with each other;

and the cylinder block 24 and the rotating shaft 23 are non-rotatable relative to each other. A plurality of cylinder chambers 24*a* are formed at the cylinder block 24 so as to be open at one end of the cylinder block 24. The pistons 25 are inserted into the cylinder chambers 24*a*.

The pistons 25 can reciprocate in the cylinder chambers 24*a*. Each piston 25 includes a convex spherical portion 25*a* at one end portion thereof, and the convex spherical portion 25*a* projects from the cylinder chamber 24*a*. The convex spherical portion 25*a* is formed in a substantially spherical shape. The shoe 26 is attached to the convex spherical portion 25*a* so as to be rollable. The shoes 26 reciprocate in an axial direction together with the pistons 25, and bottom portions of the shoes 26 are pressed against a surface of the swash plate 21. The rotating shaft 23 is inserted through an inner hole of the swash plate 21. The swash plate 21 is arranged so as to be inclined such that an upper end portion thereof is located closer to the cylinder block 24 than a lower end portion thereof. The swash plate 21 arranged as above can tilt relative to the rotating shaft 23 and can change the tilting angle thereof.

As described above, the shoes 26 are pressed against the swash plate 21 configured as above. When the cylinder block 24 rotates, the shoes 26 rotate together with the pistons 25. At this time, since the shoes 26 are pressed against one surface of the swash plate 21, the shoes 26 slide on the surface of the tilting swash plate 21 and rotate about an axis of the swash plate 21. With this, the pistons 25 reciprocate in the cylinder chambers 24*a*. Moreover, cylinder ports 24*b* connected to the cylinder chambers 24*a* are formed at the other end of the cylinder block 24. The valve plate 27 is provided so as to contact the other end of the cylinder block 24. The valve plate 27 is fixed to the casing 22 and is provided so as to be rotatable relative to the cylinder block 24. The two ports 11*a* and 11*b* respectively connected to the first liquid passage 16R and the second liquid passage 16L are formed at the valve plate 27. It should be noted that in FIG. 2, for convenience of explanation, the two ports 11*a* and 11*b* are shown so as to be displaced in a circumferential direction. Each of the two ports 11*a* and 11*b* is arranged so as to correspond to a plurality of cylinder ports 24*b*. By the rotation of the cylinder block 24, a port to which the plurality of cylinder ports 24*b* are connected is switched to one of the two ports 11*a* and 11*b*.

For example, when the rotating shaft 23 rotates in the forward direction, the hydraulic pump 11 configured as above sucks the operating liquid from the port 11*a* through the cylinder ports 24*b* to the cylinder chambers 24*a*. After the cylinder block 24 rotates by about 180 degrees, the sucked operating liquid is pushed by the pistons 25 to be discharged through the cylinder ports 24*b* and the port 11*b*. In contrast, when the rotating shaft 23 rotates in the reverse direction, the hydraulic pump 11 sucks the operating liquid from the port 11*b* and discharges the operating liquid through the port 11*a*. According to the hydraulic pump 11 configured as above, movement distances of the pistons 25 can be changed by tilting the swash plate 21, and this changes the discharge capacity q of the hydraulic pump 11. Moreover, since the movement distances change in accordance with the tilting angle of the swash plate 21, the discharge capacity q of the hydraulic pump 11 changes in accordance with the tilting angle of the swash plate 21. The hydraulic pump 11 configured as above is provided with the discharge capacity adjustment mechanism 12 shown in FIG. 1 in order to change the tilting angle of the swash plate 21.

The discharge capacity adjustment mechanism 12 is a so-called regulator. As described above, the discharge capacity adjustment mechanism 12 has the function of changing the tilting angle of the swash plate 21 to change the discharge capacity. The discharge capacity adjustment mechanism 12 mainly includes a servo piston 31, a tilting angle control valve 32, and an electromagnetic proportional control valve 33. The servo piston 31 is formed in a substantially columnar shape and is accommodated in an upper portion of the casing 22 on the paper surface of FIG. 2. The servo piston 31 is arranged in the casing 22 so as to be able to reciprocate in an axial direction of the servo piston 31. A large-diameter chamber 22*a* and a small-diameter chamber 22*b* are formed in the casing 22 at positions corresponding to both end portions of the servo piston 31. Both end portions of the servo piston 31 receive pressure pa of a pressure liquid introduced to the large-diameter chamber 22*a* (i.e., large-diameter chamber pressure pa) and pressure pb of the pressure liquid introduced to the small-diameter chamber 22*b* (i.e., small-diameter chamber pressure pb). Moreover, outer diameters of one end portion and the other end portion of the servo piston 31 are different from each other, and therefore, an area which receives the large-diameter chamber pressure pa and an area which receives the small-diameter chamber pressure pb are different from each other, i.e., pressure receiving areas are different from each other. Furthermore, the servo piston 31 includes a below-described coupler 31*a* at an intermediate portion thereof. A compression coil spring 30 is provided on a surface of the coupler 31*a* which surface is located close to the small-diameter chamber. The compression coil spring 30 that is a biasing member biases the servo piston 31 toward the large-diameter chamber 22*a* (i.e., toward a right side on the paper surface of FIG. 2). Therefore, the servo piston 31 moves to a position where the biasing force of the compression coil spring and thrust by the small-diameter chamber pressure pb are balanced with thrust by the large-diameter chamber pressure pa. It should be noted that the compression coil spring 30 does not necessarily have to be included.

The servo piston 31 is coupled to the upper end portion of the swash plate 21 by the coupler 31*a*. Therefore, when the servo piston 31 moves toward the large-diameter chamber 22*a*, the swash plate 21 inclines so as to increase the discharge capacity q. When the servo piston 31 moves toward the small-diameter chamber 22*b*, the swash plate 21 stands so as to decrease the discharge capacity q. In the hydraulic pump 11, the movement distance of the servo piston 31 toward the large-diameter chamber 22*a* is restricted as below. To be specific, when the servo piston 31 moves toward the large-diameter chamber 22*a*, the servo piston 31 contacts a wall surface of the large-diameter chamber 22*a* as a stopper and therefore cannot move further. To be specific, the movement distance of the servo piston 31 toward the large-diameter chamber 22*a* is limited by the wall surface of the large-diameter chamber 22*a*, and this limits a maximum tilt amount. The hydraulic pump 11 includes a minimum capacity adjustment mechanism 40 in order to physically limit the movement distance of the servo piston 31 toward the small-diameter chamber 22*b*. An opening at which the minimum capacity adjustment mechanism 40 is provided is formed at the small-diameter chamber 22*b* of the casing 22.

The minimum capacity adjustment mechanism 40 includes a lid body 41, a contact member 42, an adjusting screw 43, and a lock nut 44. The lid body 41 is formed in a substantially cylindrical shape. A tip end-side portion of the lid body 41 is smaller in diameter than the other portion thereof. The tip end-side portion of the lid body 41 is threadedly engaged with the opening of the small-diameter chamber 22*b* to close the opening of the small-diameter chamber 22*b*. A tip end-side portion of an inner hole of the lid body 41 is larger than a base end-side portion of the inner hole of the lid body 41. The contact member 42 having a substantially circular plate shape is fittingly inserted into the tip end-side portion of the inner hole so as to be movable along an axis of the inner hole. An O ring 45 is provided on an outer peripheral surface of the contact member 42. The O ring 45 prevents a pilot liquid from leaking outward from the small-diameter chamber 22*b*. The adjusting screw 43 is threadedly engaged with the base end-side portion of the inner hole of the lid body 41 in order to adjust the position of the contact member 42. The position of the contact member 42 can be adjusted by turning the adjusting screw 43.

According to the minimum capacity adjustment mechanism 40 configured as above, when the pressure liquid is introduced to the large-diameter chamber 22*a*, and the servo piston 31 moves toward the small-diameter chamber 22*b*, the servo piston 31 contacts the contact member 42, and therefore, the movement of the servo piston 31 is physically restricted. To be specific, the movement distance of the servo piston 31 is limited by the contact member 42, and this limits the minimum tilt amount. As described above, the position of the contact member 42 having such function can be changed by the adjusting screw 43. To be specific, by changing the position of the contact member 42, the limitation of the movement distance of the servo piston 31 can be adjusted. With this, according to the hydraulic pump 11, the tilt amount can be mechanically adjusted by turning the adjusting screw 43 of the minimum capacity adjustment mechanism 40.

As above, in the hydraulic pump 11, the movement distance of the servo piston 31 is limited by the stopper and the minimum capacity adjustment mechanism 40. This limits the tilt amount of the swash plate 21 such that the swash plate 21 moves in a range between the maximum tilt amount and the minimum tilt amount. With this, the discharge capacity q of the hydraulic pump 11 is physically limited in a range between a maximum discharge capacity $q_{max}$ and a minimum discharge capacity $q_{min}$, and the servo piston 31 moves to change the discharge capacity q within this range. The pressure liquid which moves the servo piston 31 is introduced to the large-diameter chamber 22*a* and the small-diameter chamber 22*b*. In order to introduce the pressure liquid, the chambers 22*a* and 22*b* are connected to a discharge pressure introducing passage 39 through a discharge pressure selecting passage 35.

The discharge pressure introducing passage 39 is arranged so as to connect the first liquid passage 16R and the second liquid passage 16L. A shuttle valve 34 is interposed on a portion of the discharge pressure introducing passage 39. The shuttle valve 34 is connected to the small-diameter chamber 22*b* through the discharge pressure selecting passage 35. The shuttle valve 34 arranged as above selects a higher-pressure operating liquid from the operating liquid flowing through the first liquid passage 16R and the operating liquid flowing through the second liquid passage 16L and outputs the selected higher-pressure operating liquid to the discharge pressure selecting passage 35. Moreover, the tilting angle control valve 32 and the electromagnetic proportional control valve 33 are connected to the discharge pressure selecting passage 35.

The tilting angle control valve 32 is, for example, a pilot spool valve and is connected to a tank 19 and the large-diameter chamber 22*a* in addition to the discharge pressure selecting passage 35. To be specific, the tilting angle control valve 32 adjusts the large-diameter chamber pressure pa in accordance with control pressure p input to the tilting angle control valve 32, the large-diameter chamber pressure pa being output to the large-diameter chamber 22*a*. More specifically, the tilting angle control valve 32 adjusts the large-diameter chamber pressure pa by moving a spool 32*a* in accordance with the control pressure p to change the area of an opening between the discharge pressure selecting passage 35 and the large-diameter chamber 22*a* and the area of an opening between the tank 19 and the large-diameter chamber 22*a*.

The tilting angle control valve 32 includes a sleeve 32*b*. The sleeve 32*b* is externally fitted to the spool 32*a* so as to be movable relative to the spool 32*a*. To be specific, the sleeve 32*b* can change its position relative to the spool 32*a*, and this can change the area of the opening between the discharge pressure selecting passage 35 and the large-diameter chamber 22*a* and the area of the opening between the tank 19 and the large-diameter chamber 22*a*. The sleeve 32*b* is coupled to the servo piston 31 through a feedback lever 32*c* and moves in association with the servo piston 31.

The tilting angle control valve 32 configured as above moves the spool 32*a* to adjust the large-diameter chamber pressure pa. With this, the tilting angle control valve 32 can move the servo piston 31 to change the tilting angle of the swash plate 21. Moreover, the sleeve 32*b* changes its position relative to the spool 32*a* in association with the servo piston 31. When the servo piston 31 moves to a position where forces acting on the servo piston 31 are balanced (i.e., a position corresponding to the movement distance of the spool 32*a*), the sleeve 32*b* closes the opening between the discharge pressure selecting passage 35 and the large-diameter chamber 22*a* and the opening between the tank 19 and the large-diameter chamber 22*a*. With this, the servo piston 31 can be held at a position corresponding to the control pressure p input to the tilting angle control valve 32, i.e., the tilting angle of the swash plate 21 can be held at an angle corresponding to the control pressure p input to the tilting angle control valve 32. In order to input the control pressure p to the tilting angle control valve 32 having such functions, the electromagnetic proportional control valve 33 is connected to the tilting angle control valve 32.

The electromagnetic proportional control valve 33 is connected to the tilting angle control valve 32 and the discharge pressure selecting passage 35 as described above, and is also connected to the tank 19. The electromagnetic proportional control valve 33 outputs to the tilting angle control valve 32 the control pressure p that is pressure corresponding to a signal input thereto. With this, the servo piston 31 can be made to move to a position corresponding to the signal input to the electromagnetic proportional control valve 33, and the swash plate 21 can be made to tilt at an angle corresponding to the signal. To be specific, the discharge capacity q can be adjusted to a capacity corresponding to the signal input to the electromagnetic proportional control valve 33. As described above, the electric motor 13 is coupled to the hydraulic pump 11 through, for example, a reduction gear so as to be able to drive and rotate the rotating shaft 23.

The electric motor 13 is a servomotor and is configured to be able to switch its rotational direction in accordance with a signal input thereto, i.e., is configured to be able to rotate the rotating shaft 23 in the forward direction or the reverse direction. By changing the rotational direction of the rotating shaft 23 as above, a direction in which the hydraulic pump 11 discharges the operating liquid can be switched (i.e., the ports 11*a* and 11*b* can be switched). Moreover, the electric motor 13 can change a rotational frequency N in accordance with a signal input thereto, i.e., can change a rotational frequency of the rotating shaft 23. The flow rate of the operating liquid discharged can be increased or decreased by changing the rotational frequency of the rotating shaft 23 as above. As described above, the operating liquid which is discharged while the flow rate thereof is changed is supplied from the hydraulic pump 11 to the cylinder mechanism 2 through one of the first liquid passage 16R and the second liquid passage 16L. Moreover, in addition to the hydraulic pump 11 and the cylinder mechanism 2, relief valves 17R and 17L and check valves 18R and 18L are connected to the first liquid passage 16R and the second liquid passage 16L.

The relief valves 17R and 17L are respectively connected to the first liquid passage 16R and the second liquid passage 16L and are also connected to the tank 19. When the pressure of the operating liquid flowing through the first liquid passage 16R becomes predetermined pressure or more, the relief valve 17R discharges the operating liquid to the tank 19. Moreover, when the pressure of the operating liquid flowing through the second liquid passage 16L becomes the predetermined pressure or more, the relief valve 17L discharges the operating liquid to the tank 19. To be specific, each of the pressure of the operating liquid flowing through the passage 16R and the pressure of the operating liquid flowing through the passage 16L is prevented from becoming high pressure that is the predetermined pressure or more. The check valves 18R and 18L are respectively connected to the first liquid passage 16R and the second liquid passage 16L and are also connected to the tank 19. The check valve 18R allows the flow of the operating liquid from the tank 19 to the first liquid passage 16R but blocks the flow of the operating liquid in the opposite direction. The check valve 18L allows the flow of the operating liquid from the tank 19 to the second liquid passage 16L but blocks the flow of the operating liquid in the opposite direction. Therefore, when the operating liquid flowing through the first liquid passage 16R is inadequate, the check valve 18R sucks up the operating liquid from the tank 19 and supplies the operating liquid to the first liquid passage 16R. Moreover, when the operating liquid flowing through the second liquid passage 16L is inadequate, the check valve 18L sucks up the operating liquid from the tank 19 and supplies the operating liquid to the second liquid passage 16L. It should be noted that the hydraulic pressure of the first liquid passage 16R is introduced to the check valve 18L as pilot pressure. To be specific, when the pressure (i.e., the pilot pressure) of the operating liquid flowing through the first liquid passage 16R exceeds predetermined set pressure, the check valve 18L makes the second liquid passage 16L and the tank 19 communicate with each other. According to the hydraulic pressure supply device 1 configured as above, the controller 14 is electrically connected to the electric motor 13 and the electromagnetic proportional control valve 33 so as to control the operations of the electric motor 13 and the electromagnetic proportional control valve 33.

The controller 14 outputs signals to the electric motor 13 and the electromagnetic proportional control valve 33 to control the operations of the electric motor 13 and the electromagnetic proportional control valve 33. In addition, the switching portion 15 is electrically connected to the controller 14. The switching portion 15 is, for example, a dial type or button type input unit and can be operated to instruct one of below-described three operation modes. To be specific, the switching portion 15 is configured to be able to select one of the three operation modes that are a low noise mode, a balance mode, and a low torque mode. The switching portion 15 outputs to the controller 14 a signal corresponding to the selected operation mode. The low noise mode is a mode in which the electric motor 13 is driven at not more than a first prescribed rotational frequency $N_L$ at which driving sound generated from the electric motor 13 can be suppressed.

The low torque mode is a mode in which the electric motor 13 is driven at a rotational frequency that is equal to or around a second prescribed rotational frequency $N_H$ at which the driving torque of the electric motor 13 is the lowest. The balance mode is a mode in which the electric motor 13 is driven at a rotational frequency that is equal to or around a third prescribed rotational frequency $N_B$ at which the torque of the electric motor 13 can be made low to some extent while suppressing the driving sound. It should be noted that a relation among the rotational frequencies $N_L$, $N_H$, and $N_B$ can be shown by $N_L<N_B<N_H$. When a signal is output from the switching portion 15, the controller 14 controls the operations of the electric motor 13 and the electromagnetic proportional control valve 33 in accordance with the signal. Moreover, in order to control the operations of the electric motor 13 and the electromagnetic proportional control valve 33, pressure sensors 36R and 36L, a liquid temperature sensor 37, and a rotational frequency sensor 38 are electrically connected to the controller 14.

The pressure sensors 36R and 36L that are pressure detectors are respectively connected to the two liquid passages 16R and 16L and detect the pressures of the operating liquids flowing through the corresponding liquid passages 16R and 16L. To be specific, the first pressure sensor 36R detects the pressure of the operating liquid flowing through the first liquid passage 16R, and the second pressure sensor 36L detects the pressure of the operating liquid flowing through the second liquid passage 16L. The liquid temperature sensor 37 is connected to the tank 19 and detects the temperature of the operating liquid in the tank 19. The rotational frequency sensor 38 is provided at the electric motor 13 and detects the rotational frequency N of the electric motor 13. Each of these four sensors 36R, 36L, 37, and 38 configured as above outputs to the controller 14 a signal corresponding to a detection result. The controller 14 controls the operations of the electric motor 13 and the electromagnetic proportional control valve 33 based on the signals input from the four sensors 36R, 36L, 37, and 38.

In accordance with operation steps of machines, such as lowering, pressure keeping, and rising of the cylinder mechanism 2, the controller 14 controls the rotational direction and rotational frequency of the electric motor 13 and also controls the tilting angle of the pump together with the operation of the electromagnetic proportional control valve 33. Hereinafter, among these operations of the hydraulic pressure supply device 1, control in a step of keeping pressure will be described, i.e., pressure keeping control will be described.

Figure 3:
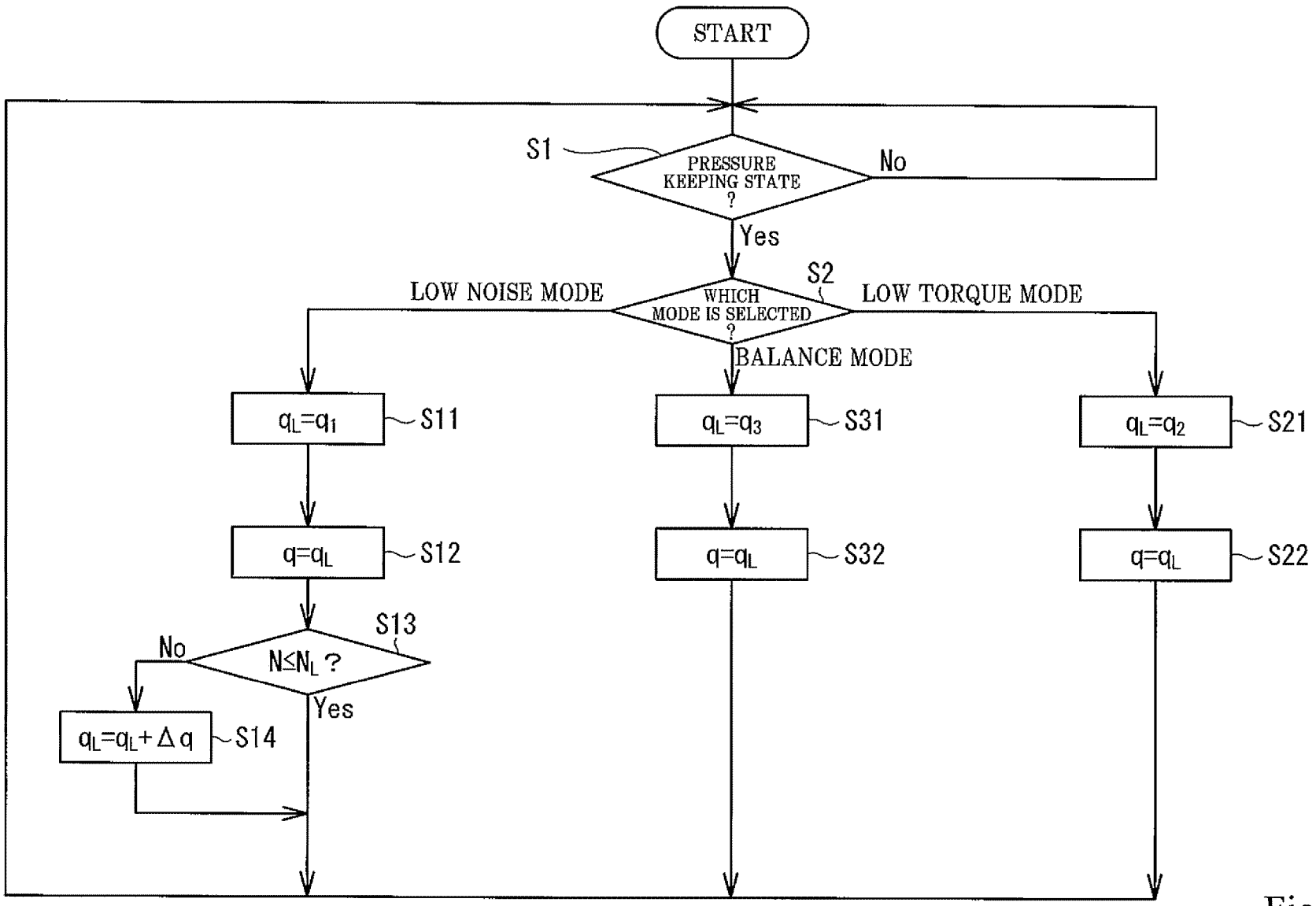
FIG. 3 is a flow chart showing a procedure of a setting process for a set lower limit discharge capacity executed by a controller of the hydraulic pressure supply device of FIG. 1.

First, typical pressure keeping control will be described. To be specific, first, the controller 14 controls the operation of the electromagnetic proportional control valve 33 in order to lower the discharge capacity q of the hydraulic pump 11 to a set lower limit discharge capacity $q_L$. The set lower limit discharge capacity $q_L$ is a discharge capacity which is set in accordance with the operation mode described below in detail and is larger than the above-described minimum discharge capacity $q_{min}$. The controller 14 controls the operation of the electromagnetic proportional control valve 33 such that the discharge capacity q of the hydraulic pump 11 becomes the above-described set lower limit discharge capacity $q_L$. Moreover, the controller 14 controls the operation of the electric motor 13 such that the liquid passage 16R or 16L connected to a discharge-side port that is the port 11*a* or 11*b* is kept at keeping pressure corresponding to a load received by the rod 2*b* of the cylinder mechanism 2. To be specific, the controller 14 performs PID control in order to adjust the rotational frequency N of the electric motor 13 such that a pressure command value from an operating device (not shown) and the detection results of the pressure sensors 36R and 36L coincide with each other. The rotational direction of the electric motor 13 reverses depending on the direction of the load received by the rod 2*b* of the cylinder mechanism 2. With this, the pressure keeping of the operating liquid can be performed in order to maintain the position of the rod 2*b* of the cylinder mechanism 2. As described above, the controller 14 having such functions changes the set lower limit discharge capacity $q_L$ in accordance with the operation mode. Hereinafter, a procedure (i.e., a setting process) of setting the set lower limit discharge capacity $q_L$ will be described with reference to a flow chart of FIG. 3.

When a power supply (not shown) is turned on, and electric power is supplied to the controller 14, the controller 14 starts the setting process. When the setting process starts, the controller 14 proceeds to Step S1. In Step S1 that is a pressure keeping determining step, it is determined whether or not one of the pressure of the operating liquid flowing through the liquid passage 16R and the pressure of the operating liquid flowing through the liquid passage 16L is kept at the keeping pressure in order to maintain the position of the cylinder mechanism 2, i.e., it is determined whether or not the hydraulic pressure supply device 1 is in a pressure keeping state in order to maintain the position of the cylinder mechanism 2. More specifically, the controller 14 detects the pressure of the operating liquid flowing through the liquid passage 16R and the pressure of the operating liquid flowing through the liquid passage 16L based on the signals from the pressure sensors 36R and 36L. Then, the controller 14 determines whether or not one of the detected two pressures is the keeping pressure or more. For example, when pressure performance becomes 80% or more of the pressure command value output during pressure control, it is determined that the pressure is the keeping pressure or more. When the hydraulic pressure supply device 1 is not in the pressure keeping state, the controller 14 performs typical rotational frequency control, i.e., the controller 14 controls the rotational direction and rotational frequency of the electric motor 13 and the tilting angle of the hydraulic pump 11 in order to lower or rise the cylinder mechanism 2. While performing such typical rotational frequency control, the controller 14 repeatedly determines whether to not the hydraulic pressure supply device 1 is in the pressure keeping state. When the controller 14 determines that the hydraulic pressure supply device 1 is in the pressure keeping state, the controller 14 proceeds to Step S2.

In Step S2 that is a selected mode determining step, the controller 14 determines which one of the three operation modes is being selected. More specifically, when the signal related to the operation mode is output from the switching portion 15, the controller 14 stores the operation mode selected based on the signal so as to overwrite the operation mode and determines the currently selected operation mode based on the stored operation mode. When the selected mode is the low noise mode, the controller 14 proceeds to Step S11.

Figure 4:
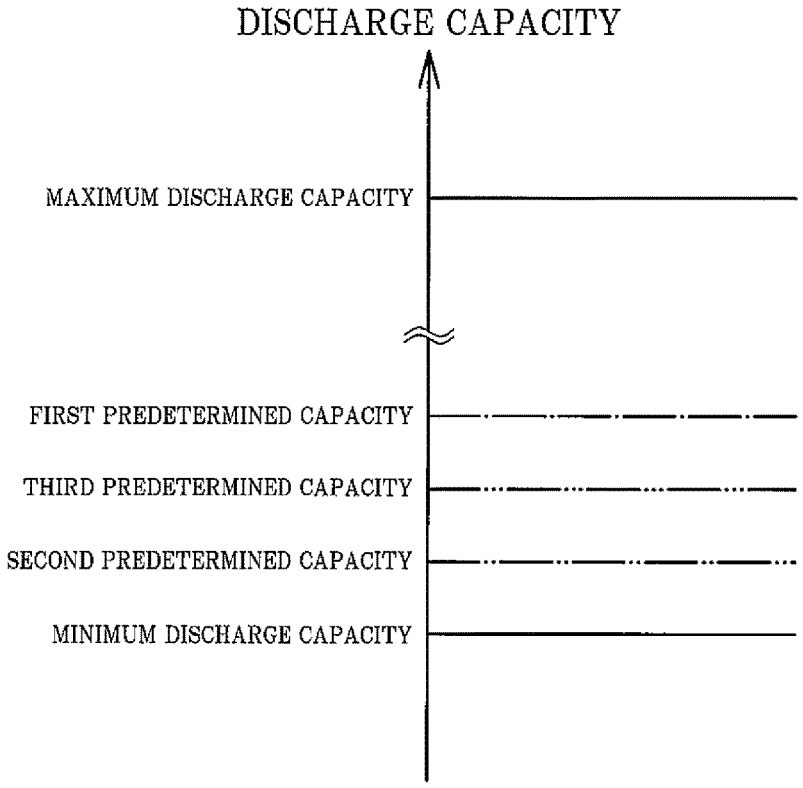
FIG. 4 is a graph showing a relation among a minimum discharge capacity and first to third predetermined capacities.

In Step S11 that is a lower limit setting step, the controller 14 sets the set lower limit discharge capacity $q_L$ to a first predetermined capacity $q_2$. The first predetermined capacity $q_1$ is set to be larger than the above-described minimum discharge capacity $q_{min}$. (see solid lines and a one-dot chain line in FIG. 4). When the set lower limit discharge capacity $q_L$ is set to the first predetermined capacity $q_1$, the controller 14 proceeds to Step S12. In Step S12 that is a discharge capacity setting step, in order to suppress the flow rate of the operating liquid discharged from the hydraulic pump 11, the controller 14 controls the operation of the electromagnetic proportional control valve 33 to set the discharge capacity q of the hydraulic pump 11 to the set lower limit discharge capacity $q_L$, i.e., the first predetermined capacity $q_1$. According to the hydraulic pressure supply device 1, the leakage rate of the operating liquid in the entire device can be roughly recognized. Therefore, a minimum discharge flow rate required in the pressure keeping state can be presumed from the leakage rate in advance. As described above, the discharge flow rate of the hydraulic pump 11 is proportional to the discharge capacity q and the rotational frequency N of the electric motor 13. The first predetermined capacity $q_1$ is set based on the minimum discharge flow rate to such a value that the electric motor 13 can mainly operate at the first prescribed rotational frequency $N_L$ at which the driving sound of the electric motor 13 is small. In the low noise mode, the discharge capacity q of the hydraulic pump 11 is basically kept at the first predetermined capacity $q_1$.

After the setting, while keeping the discharge capacity q at the first predetermined capacity $q_1$, the controller 14 controls the operation of the electric motor 13 such that the detected pressure is kept at the keeping pressure or more. When, for example, internal leakage of the hydraulic pump 11 increases due to a temperature change of the operating liquid, and therefore, the detected pressure becomes less than the keeping pressure, the controller 14 increases the pump capacity to increase the discharge flow rate of the hydraulic pump 11. Thus, the hydraulic pressure supply device 1 maintains the pressure keeping state. Regarding the setting process, when the discharge capacity q of the hydraulic pump 11 becomes the first predetermined capacity $q_1$, the controller 14 proceeds to Step S13.

In Step S13 that is a rotational frequency determining step, the controller 14 determines whether or not the rotational frequency N of the electric motor 13 is the first prescribed rotational frequency $N_L$ or less. The first prescribed rotational frequency $N_L$ is set to such a rotational frequency that the generated driving sound is an allowable volume of sound or less, or a driving sound frequency is an assumed frequency or less. With this, as described above, the driving sound generated by the electric motor 13 can be suppressed. The first prescribed rotational frequency $N_L$ is set to, for example, 10% or more and 80% or less of a maximum rotational frequency. To be specific, the controller 14 determines whether or not the driving sound generated by the electric motor 13 is large. When the controller 14 determines that the rotational frequency N of the electric motor 13 is the first prescribed rotational frequency $N_L$ or less, the controller 14 returns to Step S1 and again determines whether or not the hydraulic pressure supply device 1 is in the pressure keeping state. In contrast, when the controller 14 determines that the rotational frequency N of the electric motor 13 is higher than the first prescribed rotational frequency $N_L$ the controller 14 proceeds to Step S14.

In Step S14 that is a lower limit changing step, the controller 14 changes the set lower limit discharge capacity $q_L$. To be specific, the controller 14 increases the discharge capacity q in order to lower the rotational frequency N of the electric motor 13. The discharge flow rate of the hydraulic pump 11 is proportional to a value obtained by multiplying the rotational frequency N of the electric motor 13 by the discharge capacity q. The rotational frequency N of the electric motor 13 can be lowered by increasing the discharge capacity q. Therefore, the controller 14 increases the discharge capacity q to lower the rotational frequency N of the electric motor 13. More specifically, the controller 14 adds a predetermined increase capacity $\Delta q$ to a value set as the set lower limit discharge capacity $q_L$ and sets the obtained value as the new set lower limit discharge capacity $q_L$. When the setting of the set lower limit discharge capacity $q_L$ is changed, the controller 14 controls the operation of the electromagnetic proportional control valve 33 in order to change the discharge capacity q in accordance with the set lower limit discharge capacity $q_L$. When the discharge capacity q is changed as above, the rotational frequency N of the electric motor 13 can be lowered, and the driving sound generated by the electric motor 13 can be made small. To be specific, the noise generated by the electric motor 13 can be suppressed. Then, when the setting of the set lower limit discharge capacity $q_L$ is changed, the controller 14 returns to Step S1 and again determines whether or not the hydraulic pressure supply device 1 is in the pressure keeping state.

The following will describe a case where the operation mode selected in Step S2 is the low torque mode. When the operation mode is the low torque mode, the controller 14 proceeds from Step S2 to Step S21. In Step S21 that is the lower limit setting step, the controller 14 sets the set lower limit discharge capacity $q_L$ to a second predetermined capacity $q_2$. The second predetermined capacity $q_2$ is set to be smaller than the first predetermined capacity $q_1$ (see the solid lines and a two-dot chain line in FIG. 4). When the set lower limit discharge capacity $q_L$ is set to the second predetermined capacity $q_2$, the controller 14 proceeds to Step S22.

In Step S22 that is the discharge capacity setting step, in order to suppress the flow rate of the operating liquid discharged from the hydraulic pump 11, the controller 14 controls the operation of the electromagnetic proportional control valve 33 to set the discharge capacity q of the hydraulic pump 11 to the set lower limit discharge capacity $q_L$, i.e., the second predetermined capacity $q_2$. After the setting, while keeping the discharge capacity q at the second predetermined capacity $q_2$, the controller 14 controls the operation of the electric motor 13 such that the detected pressure is kept at the keeping pressure or more. As described above, the low torque mode is a mode in which the electric motor 13 is operated at a rotational frequency that is equal to or around the second prescribed rotational frequency $N_H$ at which the driving torque of the electric motor 13 is the lowest. In order to realize this, the second predetermined capacity $q_2$ is set based on the above-described minimum discharge flow rate to such a value that the electric motor 13 can operate at a rotational frequency that is equal to or around the second prescribed rotational frequency $N_H$ at which the driving torque of the electric motor 13 is the lowest. In the low torque mode, the discharge capacity q of the hydraulic pump 11 is kept at the second predetermined capacity $q_2$. As above, the pressure keeping state of the hydraulic pressure supply device 1 is maintained while keeping the low torque of the electric motor 13 in the low torque mode. Regarding the setting process, when the discharge capacity q of the hydraulic pump 11 becomes the second predetermined capacity $q_2$, the controller 14 returns to Step S1 and again determines whether or not the hydraulic pressure supply device 1 is in the pressure keeping state.

Finally, the following will describe a case where the operation mode selected in Step S2 is the balance mode. When the operation mode is the balance mode, the controller 14 proceeds from Step S2 to Step S31. In Step S31 that is the lower limit setting step, the controller 14 sets the set lower limit discharge capacity $q_L$ to a third predetermined capacity $q_3$. The third predetermined capacity $q_3$ is set to be smaller than the first predetermined capacity $q_1$ and larger than the second predetermined capacity $q_2$ (see the solid lines and a three-dot chain line in FIG. 4). When the set lower limit discharge capacity $q_L$ is set to the third predetermined capacity $q_3$, the controller 14 proceeds to Step S32.

In Step S32 that is the discharge capacity setting step, in order to suppress the flow rate of the operating liquid discharged from the hydraulic pump 11, the controller 14 controls the operation of the electromagnetic proportional control valve 33 to set the discharge capacity q of the hydraulic pump 11 to the set lower limit discharge capacity $q_L$, i.e., the third predetermined capacity $q_3$. After the setting, while keeping the discharge capacity q at the third predetermined capacity $q_3$, the controller 14 controls the operation of the electric motor 13 such that the detected pressure is kept at the keeping pressure or more. The balance mode is a mode in which the electric motor 13 is driven at a rotational frequency that is equal to or around the third prescribed rotational frequency $N_B$ at which the electric motor 13 can be driven at the lower torque than the low noise mode while making the driving sound smaller than that in the low torque mode. In order to realize this, the third predetermined capacity $q_3$ is set based on the minimum discharge flow rate to such a value that the electric motor 13 can operate at a rotational frequency that is equal to or around the prescribed rotational frequency $N_B$. In the balance mode, the discharge capacity q of the hydraulic pump 11 is kept at the third predetermined capacity $q_3$. Regarding the setting process, when the discharge capacity q of the hydraulic pump 11 becomes the third predetermined capacity $q_3$, the controller 14 returns to Step S1 and again determines whether or not the hydraulic pressure supply device 1 is in the pressure keeping state.

In the hydraulic pressure supply device 1 configured as above, the discharge capacity q of the hydraulic pump 11 in the pressure keeping state is set to the set lower limit discharge capacity $q_L$ that is larger than the minimum discharge capacity $q_{min}$, and the set lower limit discharge capacity $q_L$ can be changed. When the discharge capacity q is constant, in order to keep pressure, the rotational frequency N of the electric motor 13 may become excessively larger than a desired value depending on a driving state of the hydraulic pressure supply device 1. However, even when the hydraulic pressure supply device 1 is in the pressure keeping state, the discharge capacity q can be changed in accordance with the driving state of the hydraulic pressure supply device 1, such as the rotational frequency N of the electric motor 13 and the temperature of the operating liquid. Therefore, a large change in the rotational frequency N of the electric motor 13 in order to keep the hydraulic pressure of the operating liquid in the pressure keeping state can be suppressed.

According to the hydraulic pressure supply device 1, the noise of the electric motor 13 can be reduced in the low noise mode, and the electric motor 13 having low output can be used in the low torque mode. Moreover, in the balance mode, while reducing the noise of the electric motor, the electric motor 13 can be driven at the lower torque than the low noise mode, i.e., the electric motor 13 can be driven by small current, and heat generation from the electric motor 13 can be suppressed. According to the hydraulic pressure supply device 1, these three modes can be switched by the switching portion 15 in accordance with preference of a user and circumstances. Therefore, convenience as an industrial machine including the hydraulic pressure supply device 1 is high. To be specific, for example, when performing work with the industrial machine in the nighttime, the low noise mode realizes the noise reduction of the electric motor 13 in consideration of noise. Moreover, when performing work in the daytime under a circumstance where background noise is relatively large, the low torque mode can drive the device while suppressing the heat generation from the electric motor 13. Furthermore, when the generation of large sound is not preferable even in the daytime in consideration of circumstances, the balance mode can suppress the heat generation from the electric motor 13 while reducing the driving sound of the electric motor 13.

Figure 5:
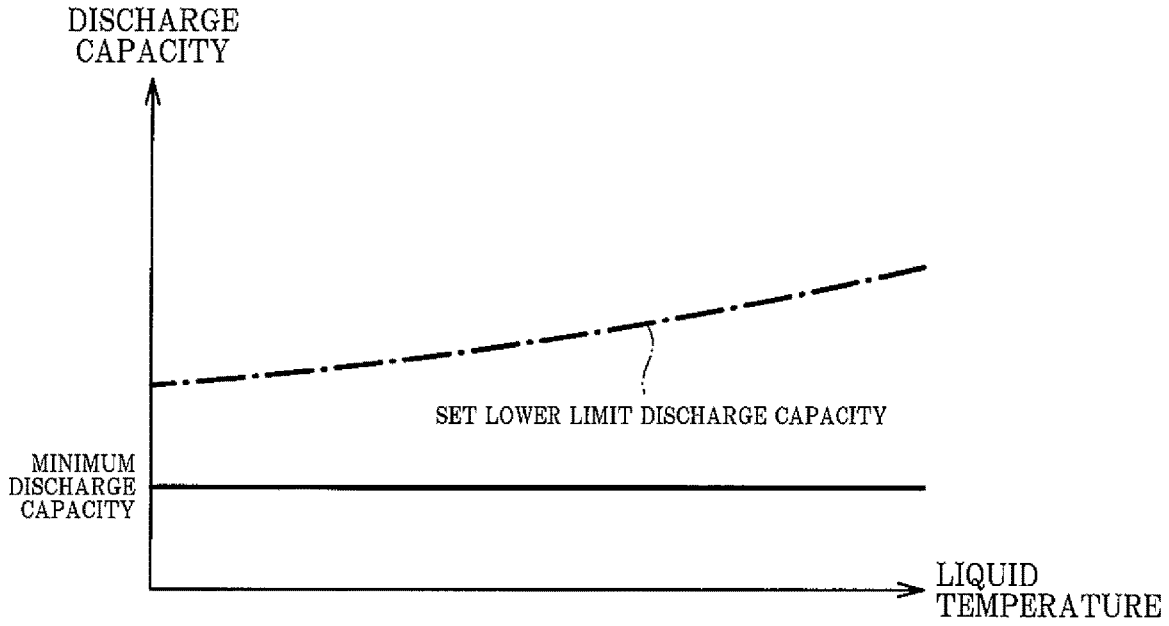
FIG. 5 is a graph showing a relation among the minimum discharge capacity, the set lower limit discharge capacity, and a liquid temperature.

The controller 14 of the hydraulic pressure supply device 1 changes the set lower limit discharge capacity $q_L$ based on the temperature of the operating liquid, i.e., the liquid temperature. To be specific, when the liquid temperature increases, viscosity decreases, and therefore, the leakage rate at a high-pressure portion in the hydraulic pressure supply device 1 increases. On this account, when the set lower limit discharge capacity $q_L$ is a fixed value, the rotational frequency N of the electric motor 13 needs to be increased in order to suppress a pressure decrease of the operating liquid. On the other hand, the controller 14 changes the set lower limit discharge capacity $q_L$ in accordance with the liquid temperature as shown in FIG. 5. To be specific, the set lower limit discharge capacity $q_L$ is basically set to be larger than the minimum discharge capacity $q_{min}$, and increases in accordance with an increase in the liquid temperature. The set lower limit discharge capacity $q_L$ may be set to a value that is not smaller than the minimum discharge capacity $q_{min}$. By setting the set lower limit discharge capacity $q_L$ as above, even when the liquid temperature increases, the pressure of the operating liquid can be kept at the keeping pressure. Moreover, the increase in the rotational frequency N of the electric motor 13 in order to keep the pressure of the operating liquid can be suppressed, and therefore, the increase in the driving sound of the electric motor can be suppressed.

Moreover, the hydraulic pressure supply device 1 can electrically change the set lower limit discharge capacity $q_L$ instead of mechanically changing the set lower limit discharge capacity $q_L$ by the minimum capacity adjustment mechanism 40. Therefore, as compared to a case where the set lower limit discharge capacity $q_L$ is mechanically changed, the set lower limit discharge capacity $q_L$ can changed more easily, and the reproducibility of the set lower limit discharge capacity $q_L$ in each mode can be improved.

Other Embodiments

In the hydraulic pressure supply device 1 of the present embodiment, the set lower limit discharge capacity $q_L$ is set based on both the operation mode and the liquid temperature. However, the set lower limit discharge capacity $q_L$ does not necessarily have to be set based on both the operation mode and the liquid temperature. To be specific, the set lower limit discharge capacity $q_L$ may be set based only on the operation mode or may be set based only on the liquid temperature. The three predetermined capacities $q_1$, $q_2$, and $q_3$ set as the set lower limit discharge capacity $q_L$ vary depending on the type of the hydraulic pump 11 (i.e., the discharge capacity q of the hydraulic pump 11) and the configuration of the hydraulic pressure supply device 1. However, as described above, the three predetermined capacities $q_1$, $q_2$, and $q_3$ can be set based on the leakage rate in the hydraulic pressure supply device 1.

The hydraulic pressure supply device 1 of the present embodiment is configured such that one mode can be selected from three operation modes. However, the number of selectable operation modes is not limited to three. For example, the selectable operation modes may be two modes that are the low noise mode and the low torque mode. The number of selectable operation modes may be four or more including a different mode(s). In the hydraulic pressure supply device 1 of the present embodiment, a swash plate pump is used as the hydraulic pump 11. However, the present embodiment is not limited to this. For example, the hydraulic pump 11 may be a bent axis pump and is only required to be able to change the discharge capacity q. The discharge capacity adjustment mechanism 12 configured to tilt the swash plate 21 does not necessarily have to be configured as above. To be specific, the servo piston 31 is of a pilot pressure type but may be of an electric type, i.e., may be directly driven by a servomotor or a solenoid. The configuration of the servo piston 31 is not limited. A bidirectional rotation pump is used as the hydraulic pump 11. However, the hydraulic pump 11 may be a unidirectional pump configured to rotate in only one direction. In this case, a direction switching valve is interposed between the pump and the actuator, and the flow direction of the operating oil is switched by the direction switching valve.

Moreover, in the hydraulic pressure supply device 1 of the present embodiment, a servomotor is adopted as the electric motor 13. However, the electric motor 13 is not necessarily limited to the servomotor and is only required to be an electric motor capable of controlling the rotational frequency. Furthermore, in the hydraulic pressure supply device 1 of the present embodiment, the cylinder mechanism 2 is disclosed as one example of the actuator. However, the actuator is not limited to the cylinder mechanism 2. For example, the actuator may be a single acting type piston and the above-described hydraulic motor and is only required to be an actuator capable of driving by being supplied with an operating liquid. Machines to which the present invention is applied are not limited to industrial machines, and the present invention is applicable to various types of robots.

REFERENCE SIGNS LIST

1 hydraulic pressure supply device
2 cylinder mechanism
11 hydraulic pump
12 discharge capacity adjustment mechanism
13 electric motor
14 controller
15 switching portion
36R first pressure sensor (pressure detector)
36L second pressure sensor (pressure detector)
37 liquid temperature sensor (liquid temperature detector)
38 rotational frequency sensor (rotational frequency detector)

The invention claimed is:

1. A hydraulic pressure supply device configured to supply to an actuator an operating liquid having a keeping pressure corresponding to a load applied to the actuator, the hydraulic pressure supply device comprising:

a hydraulic pump configured to discharge the operating liquid at a flow rate corresponding to a discharge capacity of the hydraulic pump and a rotational frequency at which the hydraulic pump is driven;

an electric motor configured to drive and rotate the hydraulic pump and change a rotational frequency of the electric motor;

a discharge capacity adjustment mechanism configured to adjust the discharge capacity of the hydraulic pump within a range between a predetermined maximum discharge capacity and a predetermined minimum discharge capacity;

a pressure detector configured to detect pressure of the operating liquid discharged from the hydraulic pump;

a rotational frequency detector configured to detect the rotational frequency of the electric motor; and a controller configured to control operations of the electric motor and the discharge capacity adjustment mechanism based on the rotational frequency detected by the rotational frequency detector such that the pressure detected by the pressure detector is kept at the keeping pressure, wherein:

when keeping the operating liquid to be supplied to the actuator at the keeping pressure, the controller controls an operation of the discharge capacity adjustment mechanism such that the discharge capacity of the hydraulic pump becomes a set lower limit discharge capacity, the set lower limit discharge capacity is set to be larger than the minimum discharge capacity and the set lower limit discharge capacity is adjusted by the controller in accordance with the rotational frequency detected by the rotational frequency detector, and when keeping the pressure of the actuator at the keeping pressure, the controller executes a first operation mode of controlling the operation of the discharge capacity adjustment mechanism such that:

when the rotational frequency of the electric motor detected by the rotational frequency detector is a predetermined first prescribed rotational frequency or less, the set lower limit discharge capacity is set to be a first predetermined capacity, and when the rotational frequency of the electric motor detected by the rotational frequency detector exceeds the first prescribed rotational frequency, the set lower limit discharge capacity is made larger than the first predetermined capacity and the rotational frequency of the electric motor that exceeds the first prescribed rotational frequency becomes the first prescribed rotational frequency or less.

2. The hydraulic pressure supply device according to claim 1, further comprising a switching portion configured to switch operation modes when keeping the pressure of the actuator at the keeping pressure, wherein:

the controller switches the operation mode to the first operation mode or a second operation mode in accordance with an operation with respect to the switching portion, and in the second operation mode, the set lower limit discharge capacity is set to a second predetermined capacity and the pressure detected by the pressure detector is kept at the keeping pressure, the second predetermined capacity being smaller than the first predetermined capacity.

3. The hydraulic pressure supply device according to claim 2, wherein:

the controller switches the operation mode to a third operation mode in accordance with the operation with respect to the switching portion, and in the third operation mode, the set lower limit discharge capacity is set to a third predetermined capacity and the pressure detected by the pressure detector is kept at the keeping pressure, the third predetermined capacity being larger than the second predetermined capacity and smaller than the first predetermined capacity.

4. The hydraulic pressure supply device according to claim 3, further comprising a liquid temperature detector configured to detect a temperature of the operating liquid, wherein:

the controller adjusts the set lower limit discharge capacity in accordance with a liquid temperature detected by the liquid temperature detector.

5. The hydraulic pressure supply device according to claim 2, further comprising a liquid temperature detector configured to detect a temperature of the operating liquid, wherein:

the controller adjusts the set lower limit discharge capacity in accordance with a liquid temperature detected by the liquid temperature detector.

6. The hydraulic pressure supply device according to claim 1, further comprising a liquid temperature detector configured to detect a temperature of the operating liquid, wherein:

the controller adjusts the set lower limit discharge capacity in accordance with a liquid temperature detected by the liquid temperature detector.

* * * * *